US008430150B2

(12) United States Patent
Sallstrom et al.

(10) Patent No.: US 8,430,150 B2
(45) Date of Patent: Apr. 30, 2013

(54) FEEDER ELEMENT

(75) Inventors: Jan Sallstrom, Gunnarskog (SE); Paul David Jeffs, Warwickshire (GB)

(73) Assignee: Foseco International Limited, Derbyshire (GB)

( * ) Notice: Subject to any disclaimer, the term of this patent is extended or adjusted under 35 U.S.C. 154(b) by 0 days.

(21) Appl. No.: 13/309,700

(22) Filed: Dec. 2, 2011

(65) Prior Publication Data

US 2012/0211192 A1 Aug. 23, 2012

(30) Foreign Application Priority Data

Feb. 17, 2011 (EP) ..... 11250182

(51) Int. Cl.
*B22C 9/08* (2006.01)

(52) U.S. Cl.
USPC ..... 164/359; 164/360

(58) Field of Classification Search ..... 164/359, 164/360
See application file for complete search history.

(56) References Cited

U.S. PATENT DOCUMENTS

| | | | | |
|---|---|---|---|---|
| 7,500,509 | B2 * | 3/2009 | Powell et al. | 164/359 |
| 2008/0230201 | A1 * | 9/2008 | Skerdi | 164/359 |
| 2009/0014482 | A1 * | 1/2009 | Tackaberry et al. | 222/591 |

FOREIGN PATENT DOCUMENTS

| | | | |
|---|---|---|---|
| DE | 20 004009 367 | U1 | 8/2004 |
| EP | 1 184 104 | B1 | 12/2004 |
| EP | 1 567 294 | B1 | 5/2006 |
| EP | 1 879 710 | B1 | 3/2009 |
| EP | 1 732 719 | B1 | 7/2009 |

* cited by examiner

*Primary Examiner* — Kevin P Kerns
*Assistant Examiner* — Kevin E Yoon
(74) *Attorney, Agent, or Firm* — Nixon & Vanderhye

(57) ABSTRACT

Feeder element for use in metal casting, having a first end for mounting on a mould pattern or swing plate, an opposite second end including a mounting plate for mounting on a feeder sleeve, and a bore between the first and second ends defined by a sidewall. The feeder element is compressible whereby to reduce the distance between the first and second ends. The bore has an axis that is offset from the centre of the mounting plate, and an integrally formed rim extends from a periphery of the mounting plate.

17 Claims, 13 Drawing Sheets

FEEDER ELEMENT

FIELD OF THE INVENTION

The present invention relates to a feeder element for use in metal casting operations utilising casting moulds, especially but not exclusively in high pressure vertically parted sand moulding systems.

BACKGROUND

In a typical casting process, molten metal is poured into a pre-formed mould cavity which defines the shape of the casting. However, as the metal solidifies it shrinks, resulting in shrinkage cavities which in turn result in unacceptable imperfections in the final casting. This is a well known problem in the casting industry and is addressed by the use of feeder sleeves or risers which are integrated into the mould during mould formation. Each feeder sleeve provides an additional (usually enclosed) volume or cavity which is in communication with the mould cavity, so that molten metal also enters into the feeder sleeve. During solidification, molten metal within the feeder sleeve flows back into the mould cavity to compensate for the shrinkage of the casting. It is important that metal in the feeder sleeve cavity remains molten longer than the metal in the mould cavity, so feeder sleeves are made to be highly insulating or more usually exothermic, so that upon contact with the molten metal additional heat is generated to delay solidification.

After solidification and removal of the mould material, unwanted residual metal from within the feeder sleeve cavity remains attached to the casting and must be removed. In order to facilitate removal of the residual metal, the feeder sleeve cavity may be tapered towards its base (i.e. the end of the feeder sleeve which will be closest to the mould cavity) in a design commonly referred to as a neck down sleeve. When a sharp blow is applied to the residual metal it separates at the weakest point which will be near to the casting surface (the process commonly known as "knock off"). A small footprint on the casting is also desirable to allow the positioning of feeder sleeves in areas of the casting where access may be restricted by adjacent features.

Although feeder sleeves may be applied directly onto the surface of the mould cavity, they are often used in conjunction with a breaker core. A breaker core is simply a disc of refractory material (typically a resin bonded sand core or a ceramic core or a core of feeder sleeve material) with a hole in its centre which sits between the mould cavity and the feeder sleeve. The diameter of the hole through the breaker core is designed to be smaller than the diameter of the interior cavity of the feeder sleeve (which need not necessarily be tapered) so that knock off occurs at the breaker core close to the casting surface.

Breaker cores may also be manufactured out of metal. DE 196 42 838 A1 discloses a modified feeding system in which the traditional ceramic breaker core is replaced by a rigid flat annulus and DE 201 12 425 U1 discloses a modified feeding system utilising a rigid "hat-shaped" annulus.

Casting moulds are commonly formed using a moulding pattern which defines the mould cavity. Pins are provided on the pattern plate at predetermined locations as mounting points for the feeder sleeves. Once the required sleeves are mounted on the pattern plate, the mould is formed by pouring moulding sand onto the pattern plate and around the feeder sleeves until the feeder sleeves are covered and the mould box is filled. The mould must have sufficient strength to resist erosion during the pouring of molten metal, to withstand the ferrostatic pressure exerted on the mould when full and to resist the expansion/compression forces when the metal solidifies.

Moulding sand can be classified into two main categories. Chemical bonded (based on either organic or inorganic binders) or clay-bonded. Chemically bonded moulding binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting.

Clay-bonded moulding sand uses clay and water as the binder and can be used in the "green" or undried state and is commonly referred to as greensand. Greensand mixtures do not flow readily or move easily under compression forces alone and therefore to compact the greensand around the pattern and give the mould sufficient strength properties as detailed previously, a variety of combinations of jolting, vibrating, squeezing and ramming are applied to produce uniform strength moulds, usually at high productivity. The sand is typically compressed (compacted) at high pressure, usually using a hydraulic ram (the process being referred to as "ramming up"). With increasing casting complexity and productivity requirements, there is a need for more dimensionally stable moulds and the tendency is towards higher ramming pressures which can result in breakage of the feeder sleeve and/or breaker core when present, especially if the breaker core or the feeder sleeve is in direct contact with the pattern plate prior to ram up.

The above problem is partly alleviated by the use of spring pins. The feeder sleeve and optional locator core (typically comprised of high density sleeve material, with similar overall dimensions to breaker cores) is initially spaced from the pattern plate and moves towards the pattern plate on ram up. The spring pin and feeder sleeve may be designed such that after ramming, the final position of the sleeve is such that it is not in direct contact with the pattern plate and may be typically 5 to 25 mm distant from the pattern surface. The knock off point is often unpredictable because it is dependent upon the dimensions and profile of the base of the spring pins and therefore can result in additional cleaning costs. The solution offered in EP-A-1184104 is a two-part feeder sleeve. Under compression during mould formation, one mould (sleeve) part telescopes into the other. One of the mould (sleeve) parts is always in contact with the pattern plate and there is no requirement for a spring pin. However, there are problems associated with the telescoping arrangement of EP-A-1184104. For example, due to the telescoping action, the volume of the feeder sleeve after moulding is variable and dependent on a range of factors including moulding machine pressure, casting geometry and sand properties. This unpredictability can have a detrimental effect on feed performance. In addition, the arrangement is not ideally suited where exothermic sleeves are required. When exothermic sleeves are used, direct contact of exothermic material with the casting surface is undesirable and can result in poor surface finish, localised contamination of the casting surface and even subsurface gas defects.

Yet a further disadvantage of the telescoping arrangement of EP-A-1184104 arises from the tabs or flanges which are required to maintain the initial spacing of the two mould (sleeve) parts. During moulding, these small tabs break off (thereby permitting the telescoping action to take place) and simply fall into the moulding sand. Over a period of time, these pieces will build up in the moulding sand. The problem is particularly acute when the pieces are made from exothermic material. Moisture from the sand can potentially react with the exothermic material (e.g. metallic aluminium) creating the potential for small explosive defects.

WO2005/051568 (the entire disclosure of which is incorporated herein by reference) discloses a feeder element (a collapsible breaker core) that is especially useful in high-pressure sand moulding systems. The feeder element has a first end for mounting on a mould pattern, an opposite second end for receiving a feeder sleeve and a bore between the first and second ends defined by a stepped sidewall. The stepped sidewall is designed to deform irreversibly under a predetermined load (the crush strength). The feeder element offers numerous advantages over traditional breaker cores including:—

(i) a smaller feeder element contact area (aperture to the casting);
(ii) a small footprint (external profile contact) on the casting surface;
(iii) reduced likelihood of feeder sleeve breakage under high pressures during mould formation; and
(iv) consistent knock off with significantly reduced cleaning requirements.

The feeder element of WO2005/051568 is exemplified in a high-pressure sand moulding system. The high ramming pressures involved necessitate the use of high strength (and high cost) feeder sleeves. This high strength is achieved by a combination of the design of the feeder sleeve (i.e. shape, thickness etc.) and the material (i.e. refractory materials, binder type and addition, manufacturing process etc.). The examples demonstrate the use of the feeder element with a FEEDEX HD-VS159 feeder sleeve, which is designed to be pressure resistant (i.e. high strength) and for spot feeding (i.e. high density, highly exothermic, thick-walled, and thus high modulus). The feeder sleeve is secured to the feeder element via a mounting surface which bears the weight of the feeder sleeve and which is perpendicular to the bore axis. For medium pressure moulding there is the potential opportunity of using lower strength sleeves i.e. different designs (shapes and wall thicknesses etc.) and/or different composition (i.e. lower strength). Irrespective of the sleeve design and composition, in use there would still be the issues associated with knock off from the casting (variability and size of footprint on the casting) and need for good sand compaction beneath the feeder element. If the feeder element of WO2005/051568 were to be employed in medium-pressure moulding lines it would be necessary to design the element so that it collapses sufficiently at the lower moulding pressure (as compared to high pressure moulding) i.e. to have a lower initial crush strength. It would also be highly advantageous to use lower strength feeder sleeves (typically lower density sleeves). In addition to removing the cost penalty (associated with having to use high strength high density sleeves), this would allow the use of sleeves better suited to the individual application (casting) in terms of volume and thermophysical properties. However, when this was first attempted it was surprisingly discovered that the feeder sleeve suffered damage and breakages on moulding which if used for casting would have resulted in the casting suffering from defects.

An improved feeder element was therefore devised and described in WO2007/141466 (the entire content of which is also incorporated herein by reference) to extend the utility of collapsible feeder elements into medium pressure moulding systems while allowing the use of relatively weak feeder sleeves without introducing casting defects. This feeder element is similar to that described above in relation to WO2005/051568 but further includes a first sidewall region defining the second end of the element and a mounting surface for a feeder sleeve in use, the first sidewall region being inclined to the bore axis by less than 90°, and a second sidewall region contiguous with the first sidewall region, the second sidewall region being parallel to or inclined to the bore axis at a different angle to the first sidewall region whereby to define a step in the sidewall. As for the feeder element described in WO2005/051568, it was similarly found that such an arrangement was advantageous in minimising the footprint and contact area of the feeder element, thereby reducing the variability associated with knock-off from the casting.

To satisfy productivity requirements, automated greensand moulding lines have become increasingly popular, for the high volume and long run manufacture of smaller castings, e.g. automotive components. Automated horizontally parted moulding lines using a matchplate (pattern plate with patterns for both cope and drag mounted on opposite sides) are capable of producing moulds at up to 100-150 per hour. Vertically parted moulding machines (such as Disamatic flaskless moulding machines manufactured by DISA Industries A/S), are capable of much higher rates of up to 450-500 moulds per hour. In the Disamatic machine, one pattern half is fitted onto the end of a hydraulically operated squeeze piston with the other half fitted to a swing plate, so called because of its ability to move and swing away from the mould. Vertically parted mould machines are capable of producing hard, rigid flaskless greensand moulds, which are particularly suited for ductile iron castings. In such applications, sand is typically blown at a pressure of 2 to 4 bar and then compacted at a squeeze pressure of 10 to 12 kPa, with a maximum of 15 kPa being used in certain high demand applications.

Castings produced horizontally offer greater flexibility in terms of ease of manufacture and there are numerous application techniques available, with potential access to the entire pattern area allowing feeders to be placed as and where required. Castings produced vertically pose greater challenges to ensure that they are consistently sound, and feeding is typically restricted to the top or side feeders placed on the moulding joint line, which makes the feeding of isolated heavier sections very difficult.

There are essentially two types of feed requirements for any casting, including those produced in vertically parted moulds.

The first feeding requirement is modulus driven, whereby modulus is a proxy for the solidification time of the casting or section of casting to be fed. For this, the feeder metal has to be liquid for a sufficient time i.e. greater than that of the casting and or casting section, to enable the casting to solidify soundly without porosity and thus produce a sound defect free casting. For these applications, it is possible to use a standard rounded profile sleeve (with a feeder element such as those shown in WO2005/051568 and WO2007/141466). In particular, for high pressure vertically parted moulding lines, compressible feeder elements are required to give the necessary sand compaction between the base of the feeder element and the pattern surface, and it has been found that the compressible feeder elements such as those in WO2005/051568 and WO2007/141466 are suitable to give the necessary sand compaction together with consistently good feeder removal (small footprint and easy knock off).

The second feeding requirement is volume driven, i.e. there is a need to supply a certain volume of liquid metal to the casting. The volume is determined by several factors, primarily the casting weight and the liquid and solid metal shrinkage of the particular metal alloy. Another factor is ferrostatic pressure (effective height of the liquid metal feeder above the neck or contact with the casting), which is particularly important for castings produced in vertically parted moulds.

It is the volume requirement and the dimensional restrictions in vertically parted casting moulds that the present invention is primarily concerned with.

SUMMARY OF THE INVENTION

In order to supply a particular volume of liquid metal to a casting, it is desirable for the sleeve to include a cavity for a sufficient volume of liquid metal above the bore of the feeder neck leading to the casting, to provide a reservoir of metal and with sufficient ferrostatic pressure to feed into the casting. Due to space restrictions and yield requirements, it is not practical to simply use a larger standard shaped (i.e. circular cross-sectional or symmetrical) feeder. For the reasons mentioned above, it is also desirable to use compressible feeder elements for use in vertically parted high pressure mould machines to ensure good sand compaction between the feeder sleeve and the pattern and good feeder knock off.

First attempts to address this requirement involved the use of feeder sleeves having a body enclosing a large cavity extending into a lower frustoconical or cylindrical neck which was fitted with a circular compressible feeder element such as those described in WO2005/051568 and WO2007/141466. The sleeve body itself was circular, with a flat closed top, however, it was difficult to retain the position of the feeder sleeve on the swing (pattern) plate during the normal movements of the swing plate in the mould making cycle. This was alleviated by introducing internal ribs or fins on the internal feeder walls and or feeder neck so that it was in contact with the locating or support pin, employed to hold the feeder sleeve on the mould pattern prior to the sleeve being compressed into the mould. An alternative approach was to use a pin with a spring loaded mechanism such as a metal ball bearing or wire at the base of the pin, such that it is in contact with the feeder element and holds this in position during moulding. On moulding, the collapsible feeder element gave the required sand compaction and the feeder sleeve was maintained in the required position. However, on casting, there was insufficient feeding of the casting, resulting in shrinkage defects being formed in the casting. In an attempt to alleviate this by increasing the ferrostatic pressure, the base of the feeder sleeve was angled, such that when the pattern was in its moulding position (vertically parted), the top end of the sleeve was positioned above the horizontal plane of the feeder neck by an angle of up to 10 degrees. This improved the feed performance by increasing the ferrostatic pressure, but not enough to produce a defect free casting. It was not possible to increase this further by increasing the angle due to the difficulty in producing a suitable slot in the sleeve for the support pin, and removing the pin after moulding without damaging the sleeve.

An alternative approach attempted was to trial vertically elongate or oval shaped non-neck down sleeves with different feeder elements. To aid vertical alignment of the sleeve and prevent rotation of the feeder sleeve on the mould pattern prior to the sleeve being compressed into the mould, specially configured support pins were used. The pins were configured for insertion through the bore of the feeder element and the end of the pin was profiled e.g. a flat blade or fin, such that it only mated with the sleeve/feeder element in one orientation and thus prevented rotation of the sleeve on the pin. Although this overcame the problem of orientation, it was found that on compression of the sand mould the feeder sleeve tended to crack. If a non-compressible neck down feeder element comprised of a resin bonded sand breaker core was used there was insufficient compaction of the moulding sand between the base of the feeder element under the sleeve and adjacent to the pattern plate, and the high moulding pressures led to cracking and breakages of the feeder element. Similarly, if a circular compressible feeder element such as those described in WO2005/051568 and WO2007/141466 was used in conjunction with a second elongate resin-bonded neck down feeder element and a feeder sleeve (i.e. a three component system) fractures and breakages to the neck down component were observed.

It is therefore an object of the present invention to provide a feeder element and feeder system that can be used in a cast moulding operation employing a pressure moulded vertically parted automatic or semi-automatic moulding machine.

According to a first aspect of the present invention, there is provided a feeder element for use in metal casting, said feeder element comprising:

- a first end for mounting on a mould pattern or swing plate;
- an opposite second end comprising a mounting plate for mounting on a feeder sleeve; and
- a bore between the first and second ends defined by a sidewall;
- said feeder element being compressible in use whereby to reduce the distance between the first and second ends;
- wherein said bore has an axis that is offset from the centre of said mounting plate and wherein an integrally formed rim extends from a periphery of said mounting plate.

Embodiments of the present aspect of the invention can therefore provide an asymmetrical feeder element that is suitable for use in high pressure vertically parted mould machines (such as those manufactured by DISA Industries A/S). As described above, it can be advantageous to use asymmetric feeder sleeves such that in use there is an increased height above the bore axis. This provides for a greater volume of metal and ferrostatic (head) pressure above the bore axis and feeder neck to ensure a greater and more efficient flow of molten metal into a mould cavity. The Applicants therefore decided to trial open-sided sleeves (instead of providing a lower neck down portion) such that the feeder element was provided on a mounting plate arranged to abut the edge of the sleeve's open-side. Thus, feeder elements such as those described in WO2005/051568 and WO2007/141466 were simply provided on elongate mounting plates for use on elongate sleeves. However, it was discovered that when high mould pressure was applied to these components, the compressible part of the feeder element collapsed as required, however, the forces absorbed and transmitted through the collapsible part and into the moulding plate caused the portion of the feeder element in contact with the sleeve to unexpectedly buckle and bend outwardly from the sleeve. This was not satisfactory because it could allow molten metal to escape from parts of the feeder sleeve other than the bore, which could, in turn, affect the casting quality and efficiency. It was therefore desirable to design a feeder element which included a collapsible portion to collapse under high pressure as well as a generally flat mounting portion which would remain rigid and not distort even when high mould pressure was applied asymmetrically.

As it was observed that the portion of the sidewall closest to the centre of the plate tended to collapse inwardly more than the remainder of the sidewall, initial work concentrated on reinforcing that area. However, it was unexpectedly found that the inclusion of an additional arc-shaped metal strengthening rib in the central region of the mounting plate or the welding of an additional metal piece to thicken the plate in this region, did not fully prevent the plate from buckling. Whilst it may be possible to prevent the deformation by making the whole of the feeder element from thicker metal, this would also prevent the bore from collapsing under pressure and so would not provide a practical solution. An alternative solution considered therefore involved the preparation of a two part unit where the compressible portion is attached to a thicker, more rigid plate. However, this solution was considered to be impractical and prohibitively expensive as machines which are designed to give high volume, long runs, and a lowest cost casting production require consumable parts like feeder elements to be low cost in order to be commercially viable.

After further work towards a practical solution, it was surprisingly found that the inclusion of a rim (which could be formed by incorporating a fold) along the peripheral edge of the mounting plate appeared to strengthen the plate to prevent buckling during compression.

As each of the prior art feeder elements were designed for feeder sleeves having a symmetrical neck (which is circular in cross-section) none of them has addressed the problem that the present invention aims to solve. Accordingly, although some of the prior art feeder elements include walls in their mounting plates, none have included an offset bore and a rim to impart a stiffening or bracing function as the bore is compressed. Instead, the prior art has focussed on the feeder systems where the sleeves have circular walls around central bores, such as those described in WO2007/141466 and DE 201 12 425 U1. In WO2007/141466 the feeder element is collapsible and in use the circular wall acting as an angled mounting surface for the sleeve, reduces the pressure on the sleeve and thereby reduces sleeve breakages. In DE 201 12 425 U1 the feeder element is rigid and does not deform in use, and in certain embodiments the mounting surface has a pair of spaced circular walls (lips) such that on moulding, the inner lip ensures that any broken pieces of the sleeve wall are retained in position and do not fall into the mould (and casting).

The rim may be formed by incorporating a bend, fold, kink or crimp in the mounting plate.

The mounting plate may be substantially planar and may be circular or non-circular in shape. In particular, the mounting plate may be elongate and/or asymmetrical, for example, by having a longer vertical than horizontal dimension (as orientated in use), thereby defining a pair of long peripheral edges. In specific embodiments, the mounting plate may be substantially oval, elliptical, square, rectangular, polygonal or obround (i.e. having two parallel straight sides and two part-circular ends).

In the case of an elongate plate, the rim may extend at least partially along the long peripheral edges (i.e. length) of the plate.

When the mounting plate is substantially circular (or where it has at least 2 axes of symmetry), there will not be a longer dimension. In those cases, the length of the plate (and consequently the long peripheral edges) will arbitrarily be defined with reference to the dimension corresponding to a line passing through the centre of the mounting plate and the centre of the bore, perpendicular to the axis of the bore (in practice this will be the vertical dimension in use). In those cases, at least part of the rim may extend in a direction substantially along the arbitrarily defined "long" peripheral edges of the plate.

For practical reasons, the bore is preferably located substantially centrally with respect to the nominal width of the mounting plate (the nominal width being the dimension orthogonal to the length).

It is believed that the force applied to the feeder element is greater in the vicinity of the bore than in the remainder of the mounting plate and, as a result, a bending moment is generated urging the mounting plate to bend about an axis that lies in the plane of the mounting plate and is substantially perpendicular to the length of the plate. The inclusion of a rim extending along the long peripheral edges of the plate (and orthogonal to said bending moment axis) therefore increases the rigidity of the mounting plate and provides resistance to the bending moment.

It will be understood that in certain embodiments the rim may extend continuously around the plate so as to form a skirt. In other embodiments, the rim may be discontinuous, i.e. in the form of a series of spaced apart tabs (which may be of the same or different lengths), or even a single tab. In a particular embodiment the rim is in the form of a pair of tabs each extending along a respective one of the long peripheral edges.

Where the rim is discontinuous, its length (or the length of each tab constituting the rim) is not particularly limited as long as it is sufficient to prevent the mounting plate from buckling when in use.

In certain embodiments, the rim (continuous or discontinuous) extends along each long peripheral edge at least from a point on a line defined by the tangent to the edge of the bore closest to the centre of the plate to a point on a line in the direction of the nominal width of the plate which passes through the centre of the plate.

In other embodiments, the rim (continuous or discontinuous) extends along each long peripheral edge at least from a point on a line in the direction of the nominal width of the plate which passes through the axis of the bore to a point on a line in the direction of the nominal width of the plate which passes through the centre of the plate.

The rim may be perpendicular to the mounting plate or sloped with respect to the mounting plate. In the case of a discontinuous rim constituted by a plurality of tabs, each tab may be similarly or differently angled with respect to the mounting plate.

In certain embodiments, the mounting plate may be substantially planar and the rim may be inclined away from the first end of the feeder element, at an angle of from 10° to 160° with respect to the plane of the mounting plate. In other embodiments, the rim may be inclined away from the first end at an angle of, for example, 20° to 130°, 30° to 120°, 40° to 110°, 50° to 100° or 60° to 95°. It will be understood that, at angles of greater than 90°, the flange will be bent under the mounting plate, the angle being measured externally from the plane of the mounting plate. At angles up to 90° the rim will extend generally outwardly from the mounting plate. An advantage of having the rim inclined at an angle of substantially 90° to the mounting plate is that the rim may in turn help with alignment of the feeder element on a feeder sleeve having a mating external surface at 90° to the mounting plate.

The depth of the rim is not particularly limited but in certain embodiments may be at least 5 mm or at least 10 mm.

The sidewall defining the bore may comprise at least one step. In particular embodiments, at least two steps or at least three steps may be provided.

Each step may be substantially circular, oval, elliptical, square, rectangular, polygonal or obround. Each step may be of the same (or a different) shape as the other steps.

Each step may be formed by a first sidewall region and a second sidewall region contiguous with the first sidewall region but wherein the second sidewall region is provided at a different angle, with respect to the bore axis, to the first sidewall region.

The first sidewall region may be parallel to the bore axis or may be inclined to the bore axis by less than 90°. The second sidewall region may be perpendicular to the bore axis or inclined to the bore axis by less than 90°.

It will be understood that the amount of compression and the force required to induce compression will be influenced by a number of factors including the material of manufacture of the feeder element and the shape and thickness of the sidewall. It will be equally understood that individual feeder elements will be designed according to the intended application, the anticipated pressures involved and the feeder size requirements.

The initial crush strength (i.e. the force required to initiate compression and irreversibly deform the feeder element over and above the natural flexibility that it has in its unused and uncrushed state) may be no more than 7000 N, may be no more than 5000 N, or may be no more than 3000 N. If the initial crush strength is too high, then moulding pressure may cause the feeder sleeve to fail before compression is initiated. The initial crush strength may be at least 250 N, or may be at least 500 N. If the crush strength is too low, then compression of the element may be initiated accidentally, for example if a plurality of elements is stacked for storage or during transport.

The feeder element of the present invention may be regarded as a collapsible breaker core as this term suitably describes some of the functions of the element in use. Traditionally, breaker cores comprise resin bonded sand or are a ceramic material or a core of feeder sleeve material. However, the feeder element of the current invention can be manufactured from a variety of other suitable materials including metal (e.g. steel, aluminium, aluminium alloys, brass, copper etc.) or plastic. In one embodiment the feeder element is metal and in a particular embodiment, the feeder element is steel. In certain configurations it may be more appropriate to consider the feeder element to be a feeder neck.

In certain embodiments, the feeder element may be formed from metal and may be press-formed from a single metal plate of constant thickness. In an embodiment the feeder element is manufactured via a drawing process, whereby a metal sheet blank is radially drawn into a forming die by the mechanical action of a punch. The process is considered deep drawing when the depth of the drawn part exceeds its diameter and is achieved by redrawing the part through a series of dies. To be suitable for press-forming, the metal should be sufficiently malleable to prevent tearing or cracking during the forming process. In certain embodiments the feeder element is manufactured from cold-rolled steels, with typical carbon contents ranging from a minimum of 0.02% (Grade DC06, European Standard EN10130-1999) to a maximum of 0.12% (Grade DC01, European Standard EN10130-1999).

As used herein, the term "compressible" is used in its broadest sense and is intended only to convey that the length of the feeder element between its first and second ends is shorter after compression than before compression. Preferably, said compression is non-reversible i.e. after removal of the compression inducing force the feeder element does not revert to its original shape.

In a particular embodiment, the sidewall of the feeder element comprises a first series of sidewall regions (said series having at least one member) in the form of rings (which are not necessarily planar) of increasing diameter (when said series has more than one member) interconnected and integrally formed with a second series of sidewall regions (said second series having at least one member). The sidewall regions may be of substantially uniform thickness, so that the diameter of the bore of the feeder element increases from the first end to the second end of the feeder element. Conveniently, the second series of sidewall regions are cylindrical (i.e. parallel to the bore axis), although they may be frustoconical (i.e. inclined to the bore axis). Both series of sidewall regions may be of non-circular shape (e.g. oval, elliptical, square, rectangular, polygonal or obround). The second sidewall region may constitute the sidewall region of the second series closest to the second end of the feeder element.

In one embodiment, the free edge of the sidewall region defining the first end of the feeder element has an inwardly directing lip or annular flange.

The compression behaviour of the feeder element can be altered by adjusting the dimensions of each sidewall region. In one embodiment, all of the first series of sidewall regions have the same length and all of the second series of sidewall regions have the same length (which may be the same as or different from the first series of sidewall regions and which may be the same as or different from the first sidewall region). In a particular embodiment however, the length of the first series of sidewall regions and/or the second series of sidewall regions incrementally increases towards the first end of the feeder element.

The feeder element may have as many as six or more of each of the first and the second series of sidewall regions. In one particularly preferred embodiment, four of the first series and five of the second series are provided, in another preferred embodiment five of the first series and six of the second series are provided.

In some embodiments, the distance between the inner and outer diameters of the first series of sidewall regions is 3 to 12 mm or 5 to 8 mm. The thickness of the sidewall regions may be 0.2 to 1.5 mm, 0.3 to 1.2 mm or 0.4 to 0.9 mm. The ideal thickness of the sidewall regions will vary from element to element and be influenced by the size, shape and material of the feeder element, and by the process used for its manufacture. In embodiments where the feeder element is press-formed from a single metal plate, the thickness of the mounting plate will be substantially the same as the thickness of the sidewall regions.

It will be understood from the foregoing discussion that the feeder element is intended to be used in conjunction with a feeder sleeve. Thus, the invention provides in a second aspect a feeder system for metal casting comprising a feeder element in accordance with the first aspect and a feeder sleeve secured thereto.

A standard feeder sleeve configured for use with a horizontally parted mould machines typically comprises a hollow body having a curved exterior and an open annular base for mounting onto a circular breaker core (collapsible or otherwise) from above. For certain applications the feeder sleeve may also be non-circular with an annular base for mounting on a non-circular breaker core.

In the feeder system of the second aspect, the feeder sleeve may be configured for use with vertically parted mould machines and may comprise a hollow body having an open side configured to mate with the mounting plate of the feeder element. The open side may be circular or non-circular in shape but is preferably elongate (i.e. the sleeve has a length and a width wherein the length is greater than the width). In specific embodiments, the open side may be substantially oval, elliptical, square, rectangular, polygonal or obround (i.e. having two parallel straight sides and two part-circular ends). The walls of the feeder sleeve may be thickened in certain regions to increase the surface area of the open side and provide greater contact area and thus greater support on the mounting plate of the feeder element. The wall of the feeder sleeve that forms the base of the feeder in use may also be profiled e.g. sloped downwards towards the position of the casting to further promote the flow and feed of molten metal from the feeder into the casting.

In use, the sleeve will be orientated such that its open side lies along a substantially vertical plane and the feeder element is located on the open side such that the bore is provided closer to a lower end of the sleeve than an upper end of the sleeve. Accordingly, the design of the feeder system will allow a head of molten metal to be provided in the sleeve above the bore to ensure an efficient supply of molten metal to the mould.

The nature of the feeder sleeve is not particularly limited and it may be for example insulating, exothermic or a combination of both. Neither is its mode of manufacture particularly limited, it may be manufactured for example using either the vacuum-forming process or core-shot method. Typically a feeder sleeve is made from a mixture of low and high density refractory fillers (e.g. silica sand, olivine, alumino-silicate hollow microspheres and fibres, chamotte, alumina, pumice, perlite, vermiculite) and binders. An exothermic sleeve further requires a fuel (usually aluminium or aluminium alloy), an oxidant (typically iron oxide, manganese dioxide, or potassium nitrate) and usually initiators/sensitisers (typically cryolite).

Feeder sleeves are available in a number of shapes including cylinders, ovals and domes. The sleeve body may be flat topped, domed, flat topped dome, or any other suitable shape. The feeder sleeve may be conveniently secured to the feeder element by adhesive but may also be push fit or have the sleeve moulded around part of the feeder element. Preferably the feeder sleeve is adhered to the feeder element.

It is preferable to include a Williams Wedge inside the feeder sleeve. This can be either an insert or preferably an integral part produced during the forming of the sleeve, and comprises a prism shape situated on the internal roof of the sleeve. On casting when the sleeve is filled with molten metal, the edge of the Williams Wedge ensures atmospheric puncture of the surface of the molten metal and release of the vacuum effect inside the feeder to allow more consistent feeding.

The feeder system may further comprise a support pin to hold the feeder sleeve on the mould pattern prior to the sleeve being compressed into the mould. The support pin will be configured for insertion through the offset bore of the feeder element and may be configured to prevent the sleeve and/or feeder element from rotating relative to the pin during compression (e.g. an end of the pin may be profiled such that it only mates with the sleeve/feeder element in one orientation). The support pin may also be further configured to include a device adjacent the base of the pin, and which is in contact with and holds the feeder element in position during the moulding cycle. This device may comprise, for example, a spring-loaded ball bearing or a spring clip that forms a pressure/contact with the internal surface of the first sidewall region of the feeder element. Other methods of holding the feeder system in place on the pattern plate during the moulding cycle may be employed, provided that certain services can be supplied to the swing plate of the moulding machine e.g. the base of a moulding pin may be temporarily magnetised using an electric coil such that when a steel or iron feeder element is used, the feeder system is held in place during moulding, or the feeder system can be placed over an inflatable bladder on the pattern plate which when inflated via compressed air, will expand against the internal bore walls of the feeder element and or sleeve during moulding. In both of these examples, the electromagnetic force or compressed air will be released immediately after moulding to allow release of the mould and sleeve system from the pattern plate. Permanent magnets may also be used in the base of the moulding pin and/or in the area of the pattern plate adjacent to the base of the moulding pin, the force of the magnet(s) being sufficient to hold the feeder system in place during the moulding cycle but low enough to allow its release and maintaining the integrity of the combined mould and sleeve system when removed from the pattern plate at the end of the moulding cycle.

BRIEF DESCRIPTION OF THE DRAWINGS

Embodiments of the invention will now be described by way of example only with reference to the accompanying drawings in which:—

DETAILED DESCRIPTION OF SPECIFIC EMBODIMENTS

In the subsequent examples various feeder systems were tested, comprising combinations of standard feeder elements, standard feeder sleeves and feeder systems (elements and sleeves), in accordance with the present invention.

The feeder sleeves were all produced from standard commercial exothermic mixtures, sold by Foseco under the trade names KALMINEX and FEEDEX, and produced using a core-shot process.

Both the standard and inventive metal feeder elements were manufactured by pressing sheet steel. The metal sheet was cold rolled mild steel (CR1, BS1449) with a thickness of 0.5 mm, unless otherwise stated.

The moulding test was conducted on a DISAMATIC moulding machine (Disa 130). A feeder system was placed on a support pin attached to a horizontal pattern (swing) plate that then swung down 90 degrees so that the pattern plate (face) was in a vertical position. A greensand moulding mixture was then blown (shot) into the rectangular steel chamber using compressed air and then squeezed against the two patterns, which were on the two ends of the chamber. After squeezing, one of the pattern plates is swung back up to open the chamber and the opposite plate pushes the finished mould onto a conveyor. Because the feeder systems were enclosed in the compressed mould, it was necessary to carefully break open each mould to inspect the feeder system. The support pin was situated in the centre of the (swing) pattern plate (750×535 mm) on a boss with a height of 20 mm. The sand shooting pressure was 2 bar and the squeeze plate pressure was either 10 or 15 kPa.

Figure 1B:
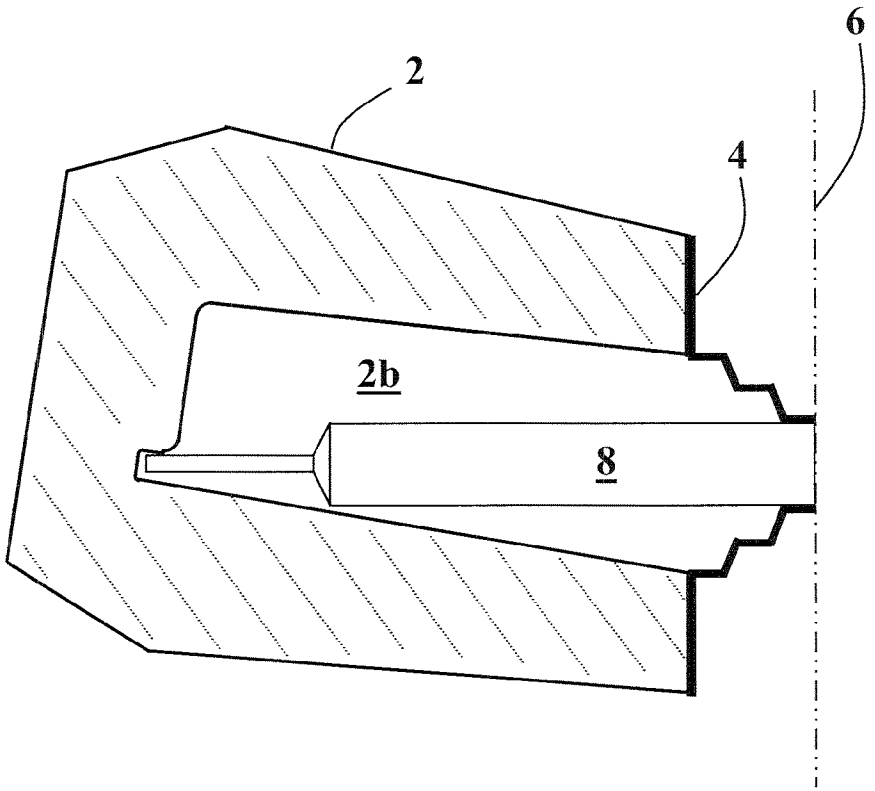
FIG. 1B shows a side cross-sectional view of the sleeve in FIG. 1A and feeder element positioned via a standard support pin to a mould pattern prior to moulding.
Figure 1A:
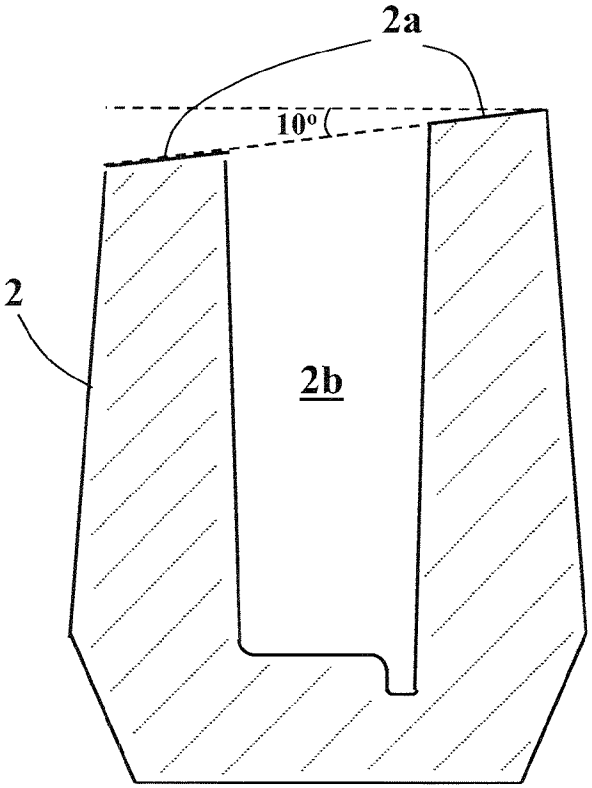
FIG. 1A shows a standard sleeve, with an angled base.

FIG. 1A shows a prior art feeder sleeve 2 having an angled base 2*a* (mounting surface). Compared with a standard feeder sleeve where the base would generally be perpendicular to the mould plate, the base is angled at 10°. FIG. 1B shows the feeder sleeve 2 attached to a known stepped and compressible metal feeder element 4 in accordance with WO2005/051568 mounted on a mould plate 6 via a fixed pin 8. The sleeve 2 is arranged such that the sleeve cavity 2*b* slopes downwardly towards the mould plate 6. It will be appreciated that the angle by which the cavity 2*b* slopes generally corresponds to the angle of the base 2*a* and the greater the angle, the greater the feeding capacity of the sleeve 2 compared to a standard sleeve. The practical limit that the base 2*a* can be angled is about 15°. Any more and the feeder element 4 does not compress completely or uniformly and the sleeve 2 separates from the feeder element 4. Moreover, the steeper the angle the more difficult it is to strip the sleeve and mould from the pin and pattern plate. Thus the problem of feeding a vertically parted mould cannot be satisfactorily solved merely by angling the base of the sleeve such that the cavity is tilted.

Figure 2B:
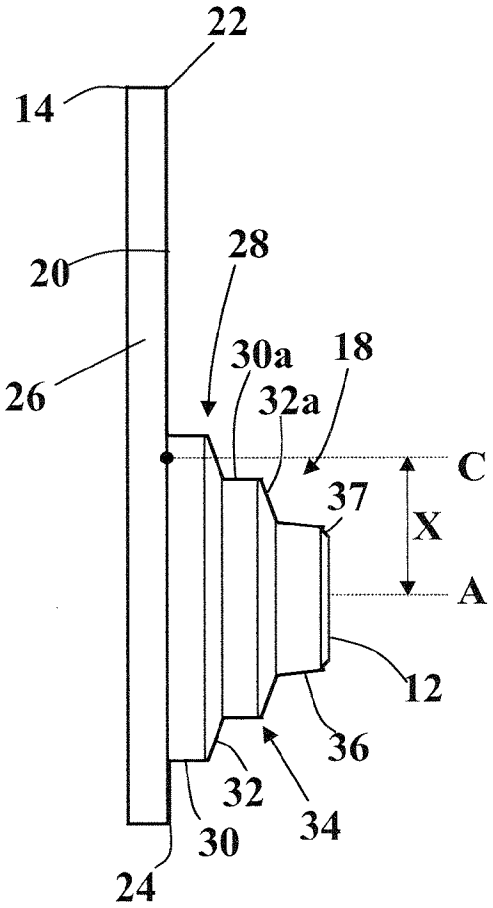
FIG. 2B shows a side view of the feeder element of FIG. 2A.
Figure 2A:
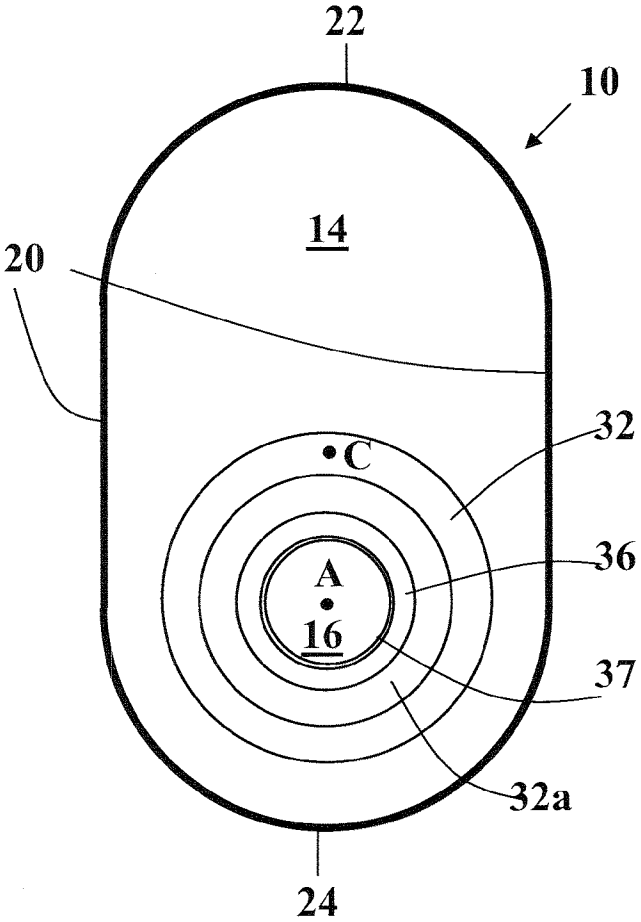
FIG. 2A shows a front view of a feeder element according to a first embodiment of the present invention.
Figure 2C:
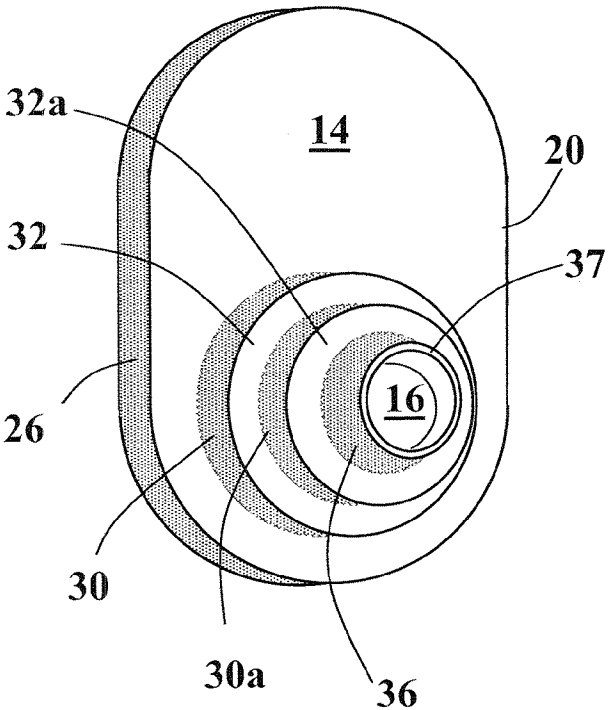
FIG. 2C shows a front perspective view of the feeder element of FIGS. 2A and 2B.

FIGS. 2A, 2B and 2C, show a feeder element 10, according to an embodiment of the present invention, comprising a first end 12 for mounting on a mould pattern (not shown); an opposite second end comprising a mounting plate 14 for mounting on a feeder sleeve (not shown); and a bore 16 between the first and second ends 12, 14 defined by a stepped sidewall 18. The bore 16 has an axis A through its centre which is offset from the centre of the plate C, by a distance x.

The mounting plate 14 is constituted by a planar obround surface (orthogonal to the axis A) having two longitudinal straight edges 20 joined by an upper part-circular top edge 22 and a lower part-circular bottom edge 24. The feeder element therefore has a length defined by the distance between the uppermost portion of the top edge 22 and the lowermost portion of the bottom edge 24 (i.e. corresponding to the long axis of the mounting plate) and a width defined by the distance between the two longitudinal edges 20.

A continuous rim or skirt 26 is provided around the peripheral edge of the mounting plate 14, which extends away from the first end 12. The rim 26 in the present embodiment is orientated at 90° to the mounting plate 14 to thereby provide a socket into which a portion of a feeder sleeve can be received.

As illustrated, the bore 16 is offset towards to the bottom edge 24 of the plate 14 and is provided centrally across the width of the feeder element 10.

The feeder element 10 is press-formed from a single metal sheet and is designed to be compressible in use whereby to reduce the distance between the first end 12 and the second end (i.e. the mounting plate) 14. This feature is achieved by the construction of the stepped sidewall 18, which in the present case comprises two circular steps between the first end 12 and the mounting plate 14. The first (and largest) step 28 comprises a first annular sidewall region 30, which is perpendicular to the plane of the mounting plate 14 (i.e. parallel to the bore axis A); and a second annular sidewall region 32, which is inwardly inclined by approximately 15° with respect to the plane of the mounting plate 14 and thereby forms a frustoconical ledge. The second (smallest) step 34 is similar to the first step 28 and comprises a first annular sidewall region 30*a*, which is perpendicular to the plane of the mounting plate 14 (i.e. parallel to the bore axis A); and a second annular sidewall region 32*a*, which is inwardly inclined by approximately 15° with respect to the plane of the mounting plate 14 and thereby forms a frustoconical ledge. A frustoconical portion 36 extends from the inner circumference of the second sidewall region 32*a* to the first end 12 to provide the opening to the bore 16 and an inwardly directed lip 37 is formed at the first end 12 to provide a surface for mounting on the mould pattern and produce a notch in the resulting cast feeder neck to facilitate its removal (knock off). In other embodiments, more steps may be provided and the first and/or second sidewall regions may be variously inclined or parallel to the bore axis A and/or the mounting plate 14.

Figure 3:
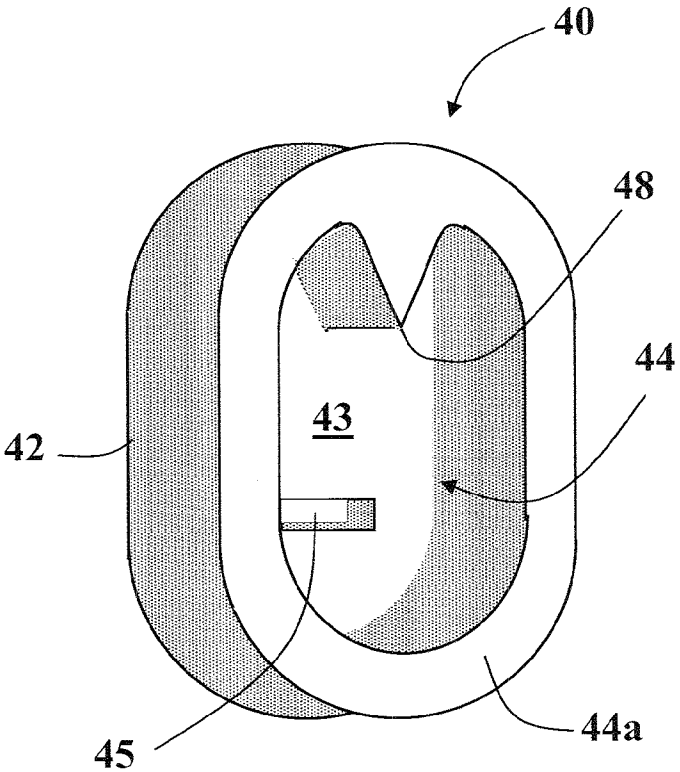
FIG. 3 shows a front perspective view of a feeder sleeve according to an embodiment of the present invention.

FIG. 3 shows a feeder sleeve 40 according to an embodiment of the present invention. The feeder sleeve 40 is configured for use with vertically parted mould machines and comprises a hollow body 42 which is substantially obround in cross-section and which has an open side 44 configured to mate at the base of the sleeve 44*a* with a mounting plate of a feeder element such as that shown in FIGS. 2A through 2C. The open side 44 is therefore substantially obround having a length and a width wherein the length is greater than the width. In the embodiment shown, a horizontal recess 45 is provided on a rear wall 43 of the body 42 for location of a support pin (not shown). Furthermore, a Williams Wedge 48 is provided at the top of the body 42, extending from the rear wall to the open side 44.

Figure 4B:
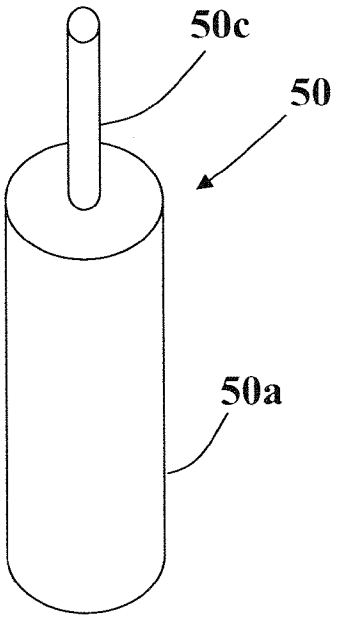
FIG. 4B shows a front perspective of the support pin of FIG. 4A.
Figure 4A:
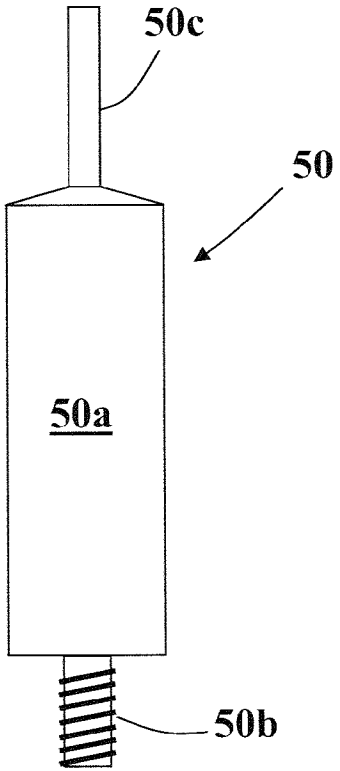
FIG. 4A shows a side cross-sectional view of a standard support pin.

FIGS. 4A and 4B show a known support pin 50 used to hold a feeder system in position on a moulding pattern, typically for use in a horizontally parted moulding machine. The body 50*a* of the pin is generally cylindrical and has a screw thread 50*b* at the base to attach it in position on the (usually metal) moulding pattern. The top of the pin 50*c* is a circular rod of relatively small diameter compared with the body, for locating within a recess on the inside of a feeder sleeve.

Figure 5B:
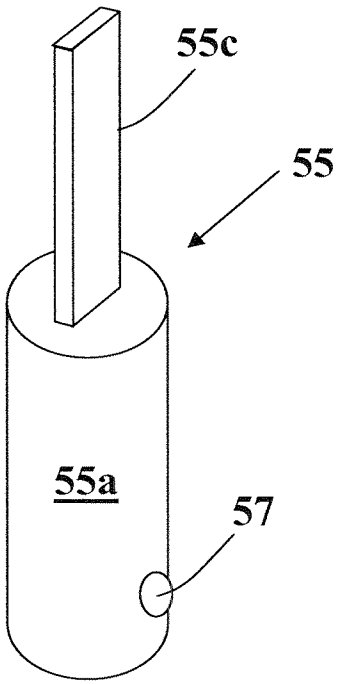
FIG. 5B shows a front perspective of the support pin of FIG. 5A.
Figure 5A:
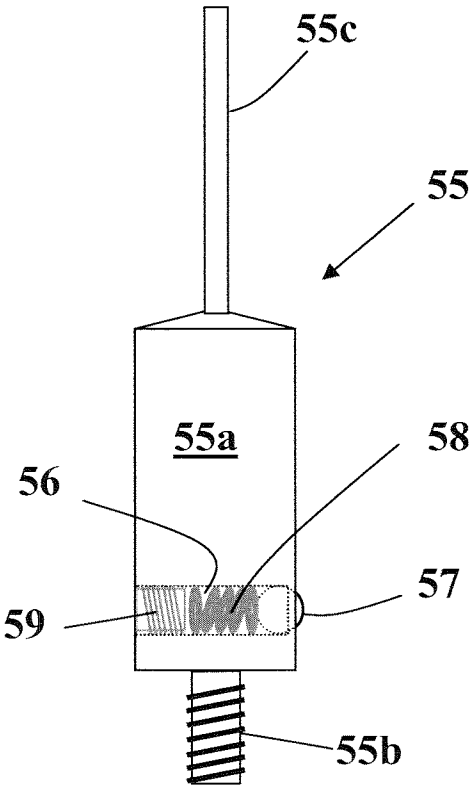
FIG. 5A shows a side cross-sectional view of a support pin for use in conjunction with the feeder sleeve in FIG. 3.

FIGS. 5A and 5B show a support pin 55 that has been modified for use with the feeder system comprising the feeder sleeve of FIG. 3 and the feeder element of FIGS. 2A-2C. The body 55*a* of the pin is cylindrical. The length of the pin body 55*a* has been shortened relative to the pin shown in FIGS. 4A and 4B, while the upper end 55*c* of the pin has been specially profiled such that it mates with the sleeve in one orientation. The upper end 55*c* has been extended lengthwise relative to the pin shown in FIGS. 4A and 4B. Rather than being a circular rod, the upper end 55*c* has a rectangular cross-section, the short side being significantly shorter than the long side. This, combined with the extended length of the upper end of the pin 55, imparts a degree of flexibility (i.e. springiness) to tolerate small movements without fracturing the feeder sleeve. Close to the base of the pin 55 (above the screw thread 55*b*), a bore 56 has been drilled perpendicular to the longitudinal axis of the pin 55, substantially but not completely through the pin 55. A ball bearing 57 is retained at the partially closed end of the bore 56, behind which sits a spring 58 and a threaded plug 59. The threaded plug 59 partially compresses the spring 58 and pushes the ball bearing 57 through the end of the bore 56 such that it protrudes partly out of the side of the pin 55.

Figure 6:
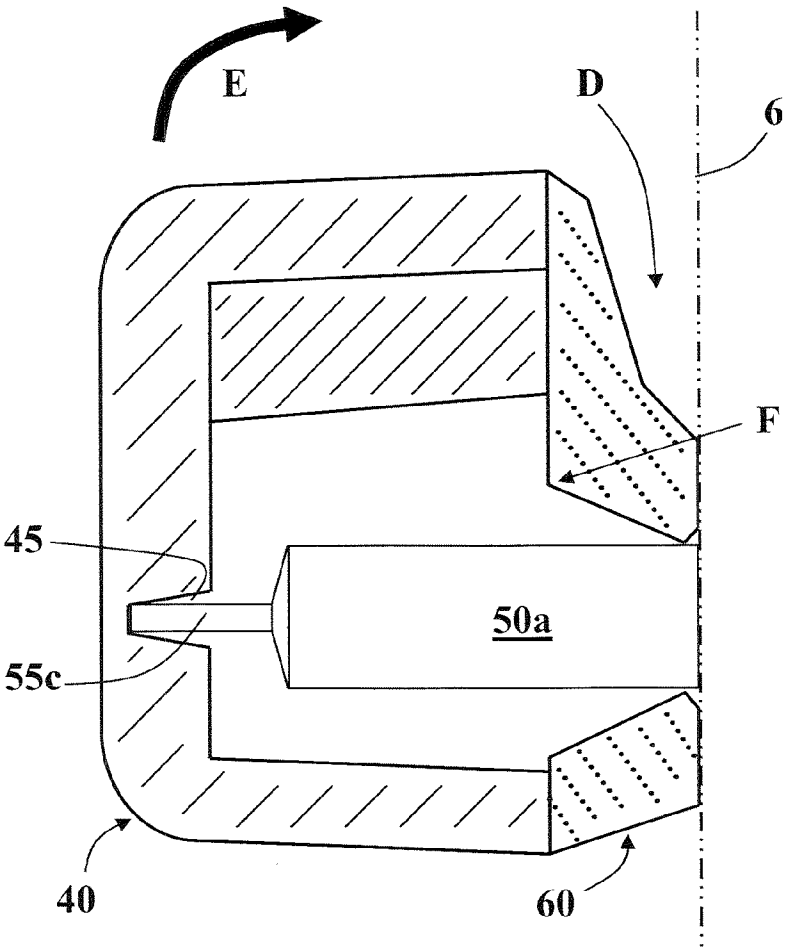
FIG. 6 shows a side cross-sectional view of the feeder sleeve of FIG. 3 used in conjunction with a comparative feeder element that is non-compressible, held in position via a support pin on a mould pattern prior to use in a vertically parted mould machine.

FIG. 6 illustrates the feeder sleeve 40 of FIG. 3 together with a known resin bonded non-compressible sand breaker core 60, when mounted on a vertical mould pattern 6 by a pin, prior to moulding and compression of the sand mould. It is noted that the pin has a standard body 50*a* and that the end 55*c* is profiled to locate in the recess 45 so as to orientate the feeder sleeve in a vertical direction to ensure maximum efficiency when supplying molten metal to the mould. Thus, it can be seen that the first end of the breaker core is held in contact with the mould pattern 6 before moulding and, because the core is non-compressible, it does not move on moulding to compact the sand in the region indicated by arrow D. Furthermore, the pressure on moulding causes the feeder sleeve to tilt upward and forward as indicated by the arrow E which causes stress on the breaker core resulting in fractures and breakages, particularly in the region indicated by arrow F.

Figure 7:
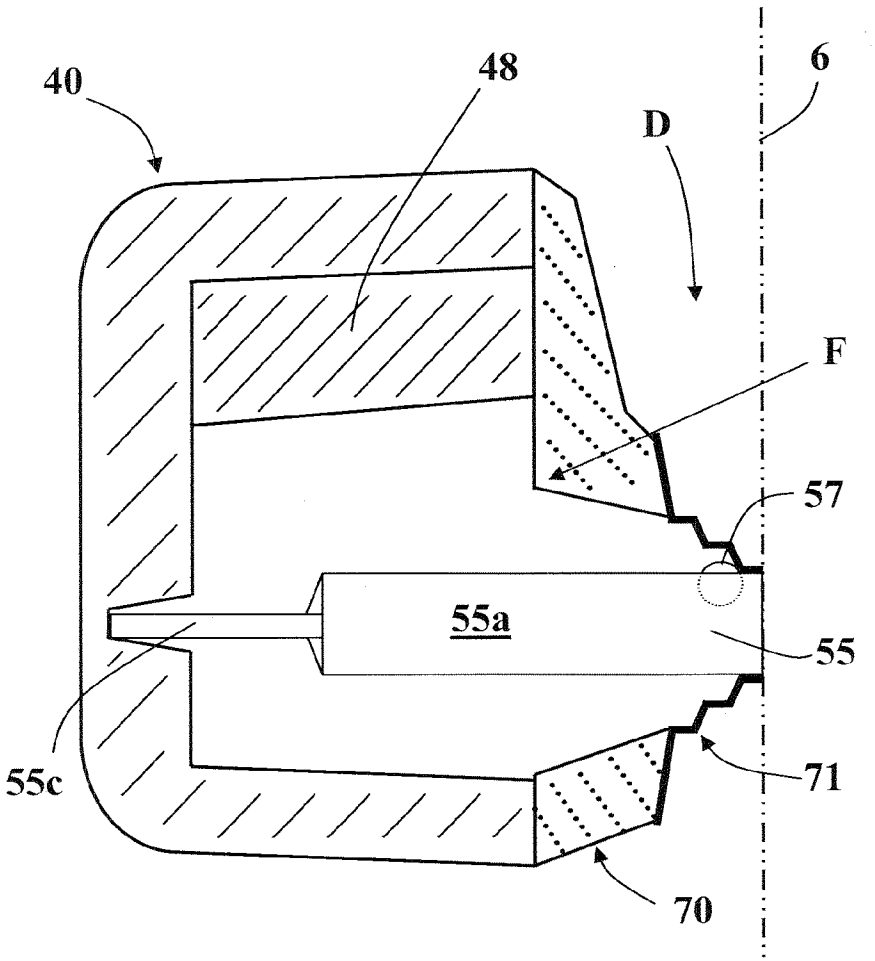
FIG. 7 shows a side cross-sectional view of the feeder sleeve of FIG. 3 used in conjunction with another comparative feeder element that is compressible, held in position via the support pin of FIG. 5A on a mould pattern.

FIG. 7 illustrates the feeder sleeve of FIG. 3 together with a known resin bonded sand neck-down component 70 and a known compressible feeder element (according to an embodiment of WO2005/051568), mounted on a vertical mould pattern 6 by a pin 55 of FIGS. 5A and 5B, prior to moulding and compression of the sand mould. As in FIG. 6, the first end of the feeder element 71 is held in contact with the mould pattern 6 before moulding, when the feeder element 71 is in its uncompressed state. On moulding, the stepped sidewall of the feeder element collapses during compression of the mould, allowing the feeder element 71 to compress and compact the sand in the region indicated by arrow D. However, the moulding pressures cause stress resulting in some fractures of the resin bonded neck down component in the region F.

Figure 8:
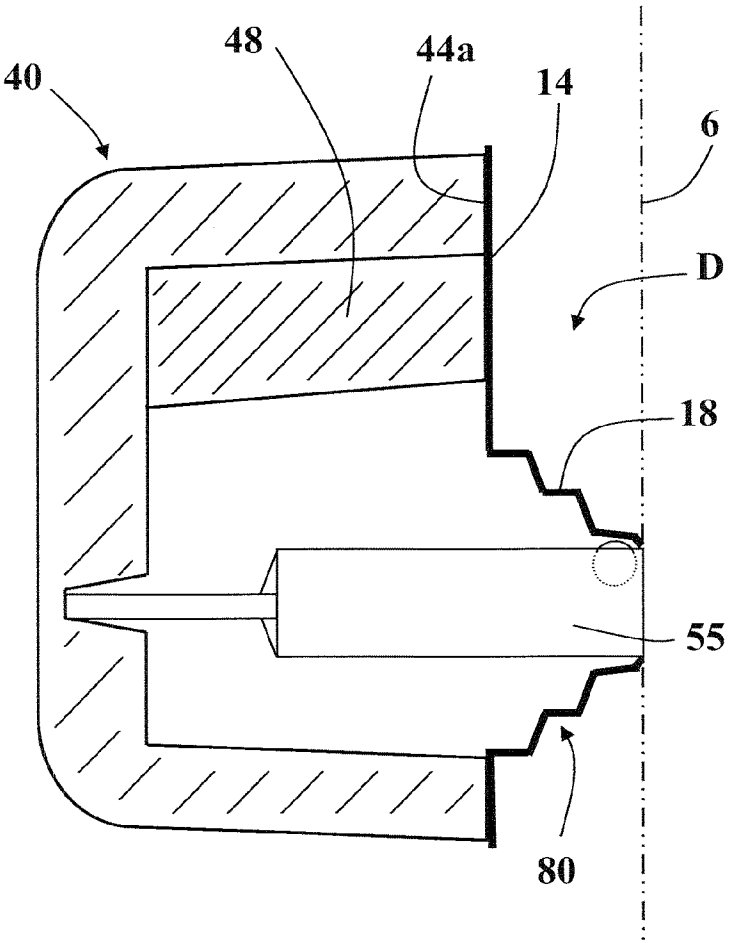
FIG. 8 shows a side cross-sectional view of the feeder sleeve of FIG. 3 used in conjunction with a further comparative feeder element, held in position via the support pin of FIG. 5A on a mould pattern.

FIG. 8 illustrates the feeder sleeve of FIG. 3 together with a modified compressible feeder element 80 mounted on a vertical mould pattern 6 by a pin 55 of FIG. 5A, prior to moulding and compression of the sand mould. The feeder element 80 is provided on the feeder sleeve 40 such that the mounting plate 14 mates with the base of the sleeve 44*a* on the open side 44. As in FIG. 7, the first end of the feeder element 80 is held in contact with the mould pattern 6 before moulding, when the feeder element 80 is in its uncompressed state. On moulding, the stepped sidewall 18 of the feeder element collapses during compression of the mould, allowing the feeder element 80 to compress and compact the sand in the region indicated by arrow D.

Figure 9:
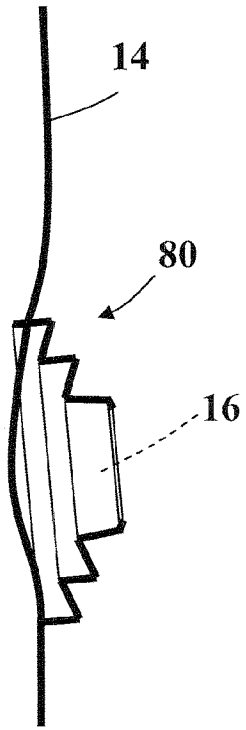
FIG. 9 shows a side view of the comparative feeder element shown in FIG. 8 after moulding to show the distortion of the planar surface.

However as shown in FIG. 9, it has surprisingly been found that when the bore 16 is offset from the centre of the mounting plate 14 and no rim is present, the mounting plate 14 will buckle thereby allowing molten metal to escape from parts of the feeder sleeve 40 other than the bore 16.

Figure 10B:
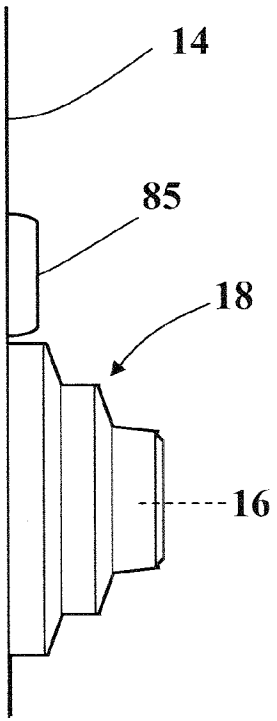
FIG. 10B shows a side view of the feeder element of FIG. 10A.
Figure 10A:
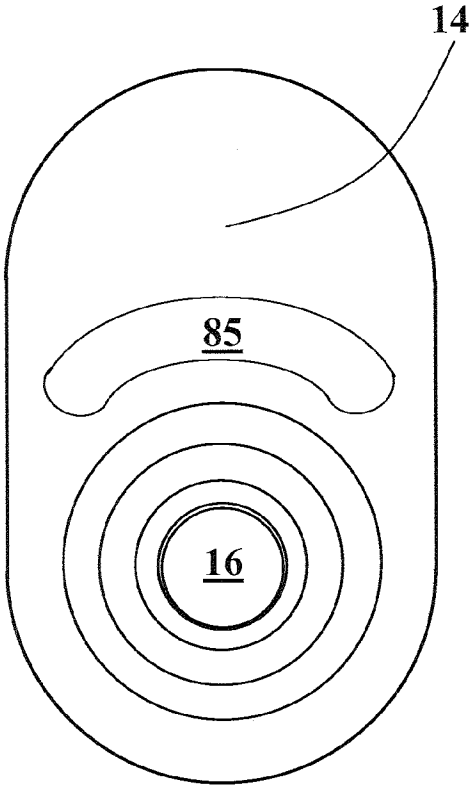
FIG. 10A shows a front view of a comparative feeder element.

FIGS. 10A and 10B show a feeder element similar to that in FIG. 8, which has been modified by form-pressing an arch-shaped rib 85. When used together with a feeder sleeve in a similar configuration to FIG. 8, the additional feature slightly reduced but did not eliminate buckling of the mounting plate when subjected to pressure on moulding.

Figure 11:
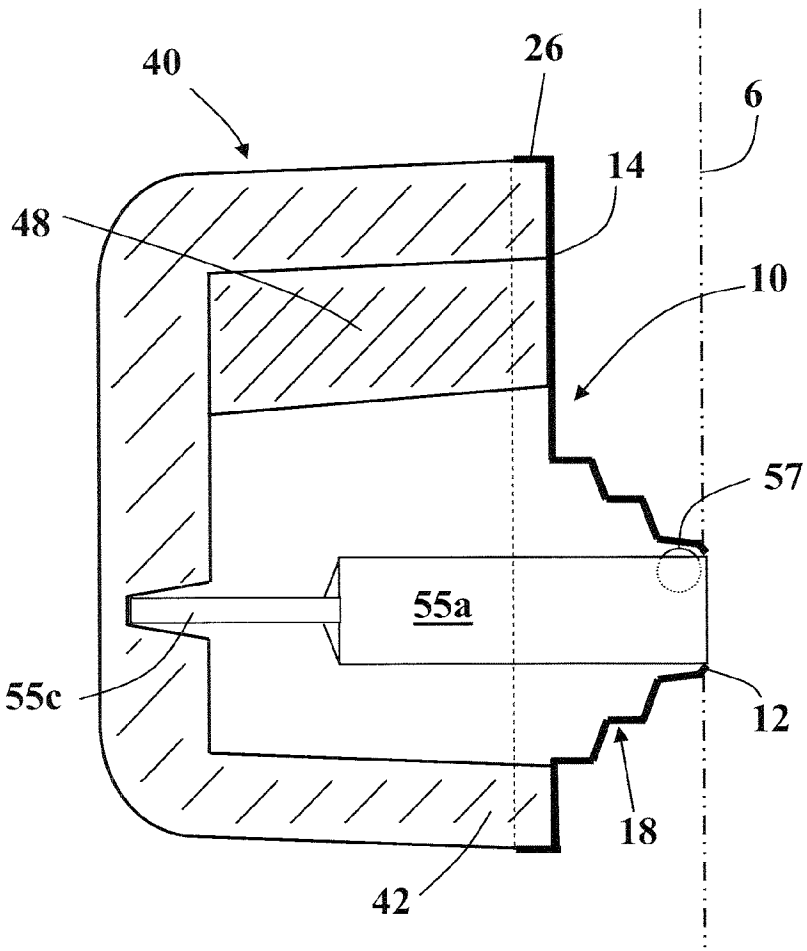
FIG. 11 shows a side cross-sectional view of a feeder system including the feeder sleeve of FIG. 3 fitted with the feeder element of FIG. 2, held in position via the support pin of FIG. 5A on a mould pattern.

FIG. 11 shows the feeder element 10 provided on the feeder sleeve 40 such that the mounting plate 14 mates with the open side 44*a* of the feeder sleeve 40 and the feeder element 10 is orientated such that the first end 12 is outwardly spaced from the lower portion of the feeder sleeve 40, with the rim 26 enveloping a portion of the body 42. Accordingly the rim 26 helps to locate and maintain the feeder element 10 on the feeder sleeve 40. In this particular embodiment the mounting plate 14 is secured to the sleeve by adhesion, however, it may alternatively be fixed by a push fit. It has also been surprisingly found that the inclusion of a rim 26 can prevent the plate 14 from buckling, thereby providing a stable and efficient feeder system.

Figure 12:
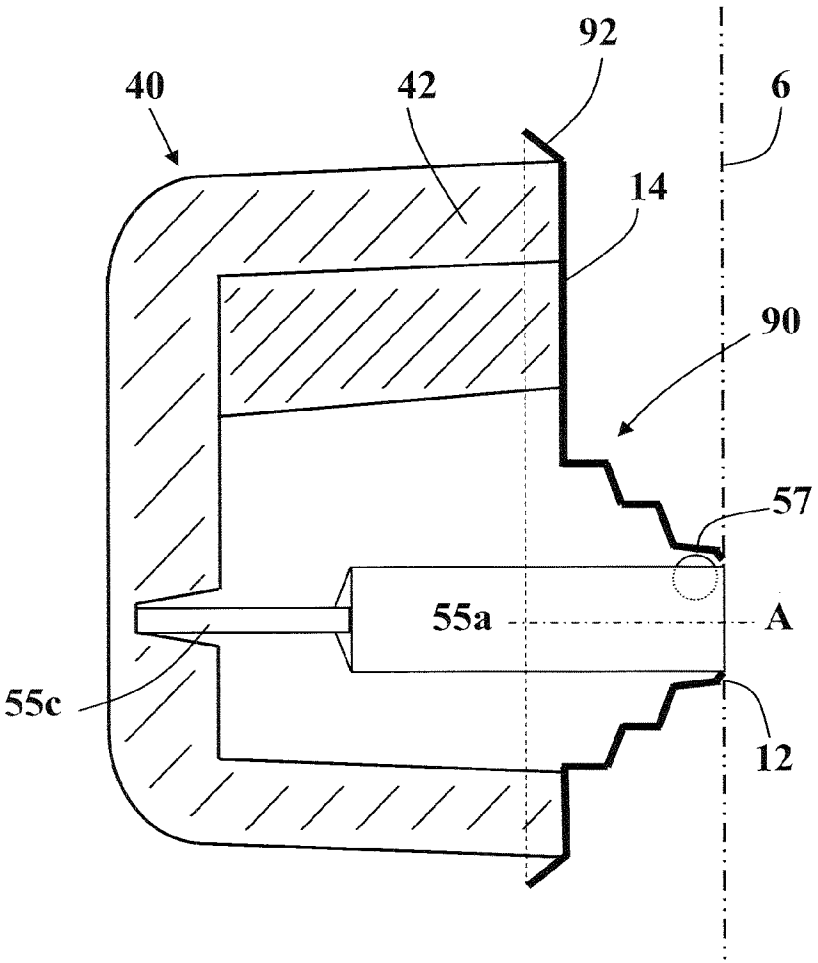
FIG. 12 shows a side cross-sectional view of a feeder system according to a further embodiment of the present invention.

An alternative feeder system is shown in FIG. 12, which is substantially similar to that shown in FIG. 11 but wherein the feeder element 90 is provided with a rim 92 which is inclined with respect to the axis A of the bore. In this instance, the rim 92 extends outwardly from the mounting plate 14, in a direction away from the first end 12, by an external angle of approximately 45° with respect to the plane of the mounting plate 14. In other words, the rim 92 forms an angle of 45° with respect to the body 42 of the feeder sleeve 40.

Figure 13B:
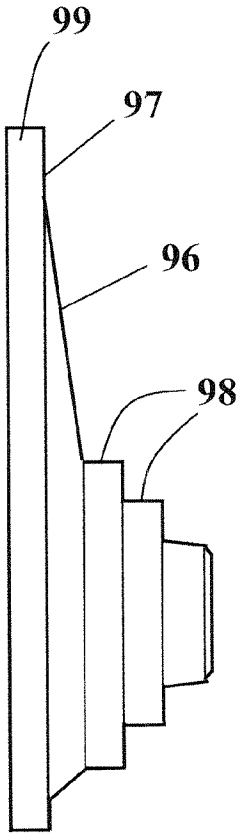
FIG. 13B shows a side view of the feeder element of FIG. 13A.
Figure 13A:
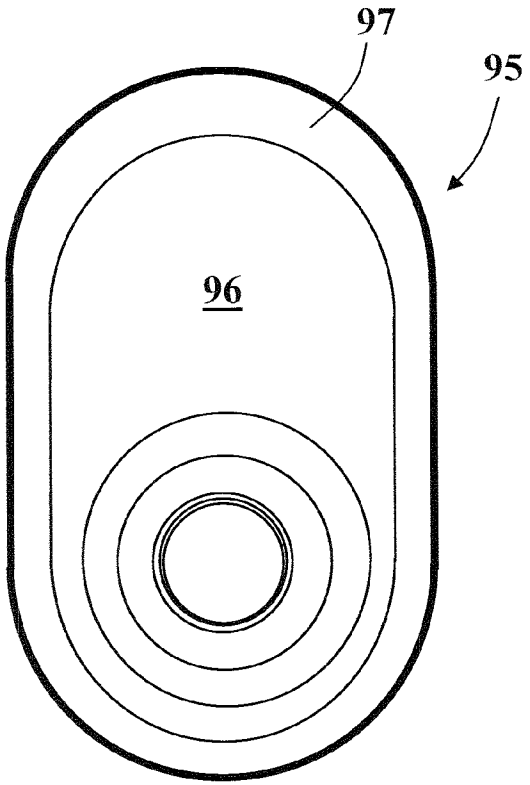
FIG. 13A shows a front view of a feeder element according to a further embodiment of the present invention.

A further embodiment of the present invention is shown in FIGS. 13A and 13B. The feeder element 95 of FIGS. 13A and 13B is substantially similar to that shown in FIG. 11. However, disposed between the mounting plate 97 and steps 98 is a flared region 96. In this embodiment, the mounting plate 97 extends inwardly from the rim 99 by a constant distance around the periphery of the feeder element 95. Thus it will be understood that the angle between the mounting plate 97 and flared region 96 varies around the periphery of the element 95.

It has been found that such an arrangement also prevents the mounting plate 97 from buckling when the feeder element is compressed during use and provides for improved compaction of the sand.

Figure 14:
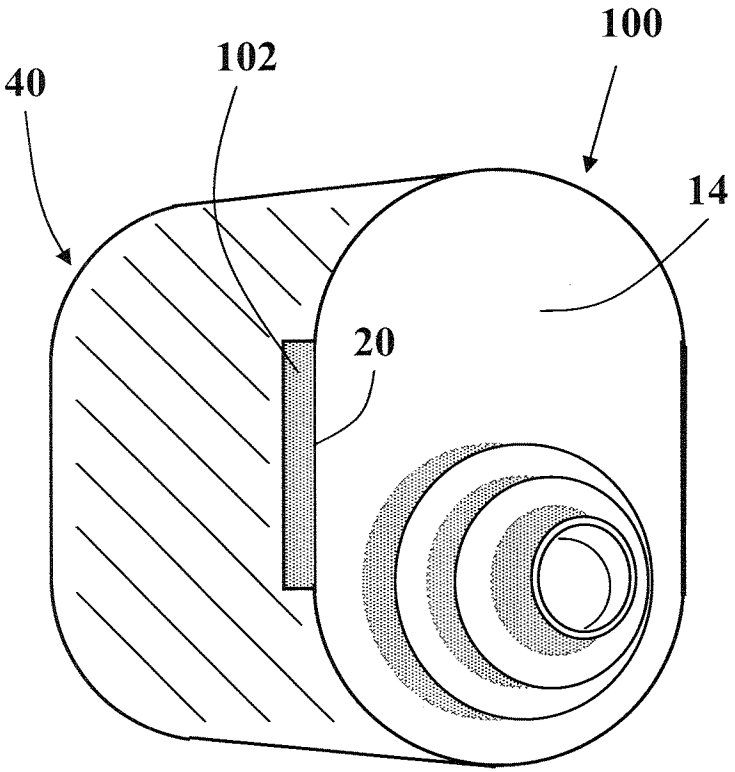
FIG. 14 shows a front perspective view of a feeder system according a further embodiment of the present invention, in which the feeder element includes a rim in the form of two opposed straight-sided tabs at 90° to the plane of the mounting plate.

A further embodiment of the present invention is shown in FIG. 14. As above, the feeder system of FIG. 14 is substantially similar to that shown in FIG. 11 (like parts being described using corresponding reference numerals) except the feeder element 100 is provided with a rim in the form of two discrete tabs 102 provided along the two longitudinal straight edges 20 of the mounting plate 14. In other words, the rim is discontinuous and is only provided along the straight edges 20. It has been found that such an arrangement is sufficient to prevent the mounting plate 14 from buckling when the feeder element 100 is compressed during use.

Figure 15:
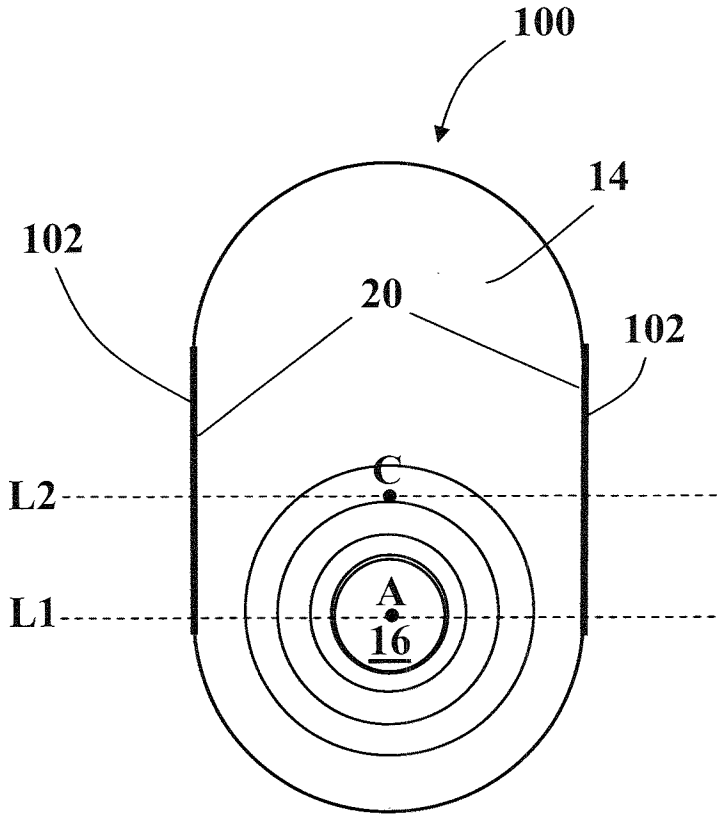
FIG. 15 shows a front view of the feeder system of FIG. 14, illustrating the extent of the tabs with respect to the position of the bore.

FIG. 15 shows a front view of the feeder system of FIG. 14 and illustrates that each of the tabs 102 forming the rim extend from below a point on a line (L1) that is in the direction of the width of the plate 14 and which passes through the axis A of the bore 16, to above a parallel line (L2) that passes through the centre C of the mounting plate 14.

It will be understood that various modifications may be made to the above described embodiments, without departing from the scope of the present invention as defined in the claims.

EXAMPLES

Various feeder systems were prepared using the feeder sleeve 40 as in FIG. 3, in combination with various feeder elements, and moulded as described above. The KALMINEX feeder sleeve had the dimensions 90 mm length×60 mm width×60 mm depth, where the length and width are the dimensions of the open face, and the depth of the feeder was measured from the open face to the closed back wall of the feeder.

The results are summarised in Tables 1a and 1b below.

TABLE 1a

Feeder Element Details

| Feeder System | Element Type/Design | Bore Diameter | Bore Offset (HC) | Rim Type/Design | Rim Width | Rim Angle |
|---|---|---|---|---|---|---|
| Comparative 1 | Resin bonded sand Design as in FIG. 6 | 25 mm | 15 mm | None | n/a | n/a |
| Comparative 2 | Resin bonded sand neck down plus 0.5 mm steel, circular compressible. Design as in FIG. 7 | 18 mm | 15 mm | None | n/a | n/a |
| Comparative 3 | 0.5 mm steel, obround, compressible Design as in FIG. 8 | 18 mm | 15 mm | None | n/a | n/a |
| Comparative 4 | 0.5 mm steel, obround, compressible Design as in FIGS. 10A/B | 18 mm | 15 mm | None | n/a | n/a |
| Example 1 | 0.5 mm steel obround compressible. Design as in FIGS. 2A-C | 18 mm | 15 mm | Continuous | 5 mm | 90 |
| Example 2 | 0.5 mm steel obround compressible. Design as in FIG. 14 | 18 mm | 15 mm | Discontinuous, two 1 cm gaps, one in each curved region of the mounting plate (top and bottom) | 5 mm | 90 |
| Example 3 | 0.5 mm steel obround compressible. | 18 mm | 15 mm | Discontinuous, two 1 cm gaps, one in each curved region of the mounting plate (top and bottom) | 5 mm | 80 |
| Example 4 | 0.5 mm steel obround compressible. | 18 mm | 15 mm | Discontinuous, two 1 cm gaps, one in each curved region of the mounting plate (top and bottom) | 5 mm | 70 |
| Example 5 | 0.5 mm steel obround compressible. | 18 mm | 15 mm | Discontinuous, two 1 cm gaps, one in each curved region of the mounting plate (top and bottom) | 5 mm | 60 |
| Example 6 | 0.5 mm steel obround compressible. | 18 mm | 15 mm | Discontinuous, two 1 cm gaps, one in each curved region of the mounting plate (top and bottom) | 5 mm | 50 |
| Example 7 | 0.5 mm steel obround compressible. | 18 mm | 15 mm | Discontinuous, two 1 cm gaps, one in each curved region of the mounting plate (top and bottom) | 10 mm | 50 |
| Example 8 | 0.5 mm steel obround compressible. | 18 mm | 7.5 mm | Discontinuous, two 1 cm gaps, one in each curved region of the mounting plate (top and bottom) | 5 mm | 50 |
| Example 9 | 0.5 mm steel obround compressible. | 18 mm | 7.5 mm | Discontinuous, two 1 cm gaps, one in each curved region of the mounting plate (top and bottom) | 5 mm | 90 |
| Example 10 | 0.5 mm steel obround compressible. Design as in FIG. 14 | 18 mm | 15 mm | Discontinuous - two discrete tabs along the longitudinal length of the mounting plate | 5 mm | 90 |
| Example 11 | 0.5 mm steel obround compressible. | 18 mm | 15 mm | Discontinuous, two discrete tabs along the curved ends of the mounting plate | 5 mm | 90 |

TABLE 1b

| Moulding Test Results | | | | | |
|---|---|---|---|---|---|
| | Feeder System Details | | | | |
| Feeder System | Rim Width | Rim Angle | Bore Offset (HC) | Squeeze Plate Pressure (kPa) | Results and Observations |
| Comparative 1 | n/a | n/a | 15 mm | 10 | Element broken into pieces. Sleeve damaged. No/poor sand compaction under sleeve |
| Comparative 2 | n/a | n/a | 15 mm | 10 | Element compressed evenly. Resin bonded sand element fractured. Minor sleeve damage. Good sand compaction under sleeve |
| Comparative 3 | n/a | n/a | 15 mm | 10 | Element compressed 7 mm, and pushed into sleeve area, particularly at the top i.e. titled/pushed inwards. Mounting plate buckled (see FIG. 9). Sleeve damaged and/or separated in parts. |
| Comparative 4 | n/a | n/a | 15 mm | 10 | Element compressed 8 mm. Mounting plate buckled, but less than Comparative 3. Some sleeve damage and/or separation from mounting face. |
| Example 1 | 5 mm | 90 | 15 mm | 10 | Element compressed 8 mm. No buckling (of mounting plate). No sleeve damage. Good sand compaction under sleeve. |
| Example 2 | 5 mm | 90 | 15 mm | 10 | Element compressed 8 mm. No buckling (of mounting plate). No sleeve damage. Good sand compaction under sleeve. |
| Example 3 | 5 mm | 80 | 15 mm | 10 | Element compressed 6 mm. No buckling (of mounting plate). No sleeve damage. Good sand compaction under sleeve. |
| Example 4 | 5 mm | 70 | 15 mm | 10 | Element compressed 7 mm. No buckling (of mounting plate). No sleeve damage. Good sand compaction under sleeve. |
| Example 5 | 5 mm | 60 | 15 mm | 10 | Element compressed 6 mm. No buckling (of mounting plate). Slight tipping of feeder system (sleeve and element). No sleeve damage. Good sand compaction under sleeve. |
| Example 6 | 5 mm | 50 | 15 mm | 10 | Element compressed 8 mm. No buckling (of mounting plate). Slight tipping of feeder system (sleeve and element). No sleeve damage. Good sand compaction under sleeve. |
| Example 7 | 10 mm | 50 | 15 mm | 10 | Element compressed 8 mm. No buckling (of mounting plate). No sleeve damage. Good sand compaction under sleeve. |
| Example 8 | 5 mm | 50 | 7.5 mm | 10 | Element compressed 9 mm. No buckling (of mounting plate). Reduced/no tipping of feeder system. No sleeve damage. Good even sand compaction under sleeve. |
| Example 9 | 5 mm | 90 | 7.5 mm | 10 | Element compressed 9 mm. No buckling (of mounting plate). Reduced/no tipping of feeder system. No sleeve damage. Good even sand compaction under sleeve. |
| Example 10 | 5 mm | 90 | 15 mm | 10 | Element compressed 6 mm. No buckling (of mounting plate). Reduced/no tipping of feeder system. No sleeve damage. Good sand compaction under sleeve. |
| Example 11 | 5 mm | 90 | 15 mm | 10 | Element compressed 6 mm, minor deflection into sleeve. Minor signs of buckling (of mounting plate) along the longitudinal sides (without rim), but no sleeve damage/ parting from plate. Good sand compaction under sleeve. |
| Example 2 | 5 mm | 90 | 15 mm | 15 | Element compressed 7 mm. No buckling (of mounting plate). Slight tipping of feeder system (sleeve and element). Notable tipping forward of feeder system. No sleeve damage. Good sand compaction under sleeve. |
| Example 3 | 5 mm | 80 | 15 mm | 15 | Element compressed 6 mm. No buckling (of mounting plate). Slight tipping of feeder system (sleeve and element). Notable tipping forward of feeder system. No sleeve damage. Good sand compaction under sleeve. |
| Example 5 | 5 mm | 60 | 15 mm | 15 | Element compressed 6 mm. No buckling (of mounting plate). Slight tipping of feeder system (sleeve and element). Notable tipping forward of feeder system. Some sleeve damage. Good sand compaction under sleeve. |
| Example 6 | 5 mm | 50 | 15 mm | 15 | Element compressed 6 mm. No buckling (of mounting plate). Slight tipping of feeder system (sleeve and element). Notable tipping forward of feeder system. Some sleeve damage. Good sand compaction under sleeve. |

To evaluate the casting (feeding) performance of the sleeves, simulations were run using the MAGMASOFT simulation tool. MAGMASOFT is a leading casting process simulation tool supplied by MAGMA Gieβreitechnologie GmbH that can model the mould filling and solidification of castings, and is typically used by foundries to avoid expensive and time consuming foundry trials. The initial MAGMASOFT results were positive, but not totally conclusive due to some limitations in the MAGMASOFT simulation tool for this particular application (casting/feeder orientation), hence actual casting trials were conducted.

Two feeding systems were evaluated to determine whether the feeder was able to feed uphill into the casting when applied to the vertical plane of a casting. Comparative Example 5 consisted of an exothermic FEEDEX high density feeder sleeve as shown in FIG. 1B, the base angled at 10° and with a circular stepped 0.5 mm steel compressible feeder element (breaker core). The product, as supplied by Foseco under the trade name FEEDEX HD VSK/33MH has an internal sleeve volume of 135 $cm^3$. Example 12 consisted of an exothermic FEEDEX high density obround section sleeve as shown in FIG. 3, with an exterior length (height when in use) of 120 mm and a width of 80 mm, and an internal sleeve volume of 254 $cm^3$, attached to a 0.5 mm steel obround compressible feeder element with a discontinuous rim with two 1 cm gaps, one in each curved region of the mounting plate.

The first casting trial to evaluate feed performance, consisted of a 13 cm square plate cast vertically, the plate having a T-shaped cross section when viewed from above. The mould contained cavities for two castings, each bottom gated from a single downsprue. The feeder was centred in/on the vertical face of the plate via a locating pin on the pattern plate. The moulds were actually produced horizontally parted using furane resin bonded sand, the mould then assembled (closed), rotated 90 degrees and cast vertically. The castings were made in ductile iron (Grade GJS500) and poured at 1360° C. Once cooled, the castings were removed from the mould and inspected by sectioning through their vertical centre-line. The casting produced using the Comparative Example 5 feeder system showed the presence of a large blow shrinkage in the top part of the casting above the feeder, whereas the casting produced using Example 12 showed no casting defects, only minor porosity and suck-in in the feeder neck.

The second casting trial was conducted under foundry conditions on a Disamatic greensand moulding line. The casting chosen was a generic 10 kg ductile iron casting that had previously been successfully produced on a horizontal high pressure greensand moulding line, with FEEDEX HD feeder sleeves on the two thick sections of the casting. For the trial, a pattern plate with a new running system was designed and produced for the Disamatic moulding machine. The test feeders were placed on locating pins prior to moulding and the moulds produced using a sand shooting pressure of 2 bar and a squeeze pressure of 10-12 kPa. Inspection of the moulds prior to closure showed excellent sand compaction in the area around and under the sleeve and compressed feeder element. Feeder knock off of both feeder designs was excellent, leaving only a small footprint of the casting.

Inspection of the casting produced using Comparative Example 5, showed that the lower thick section of the casting around the lower feeder was sound i.e. no signs of porosity, however the thick casting section below the upper sleeve contained some porosity and the feeder had drained. In contrast, the casting produced using the Example 12 feeder systems showed no signs of porosity in the casting and specifically none in either the lower or upper thick sections around the two feeders.

The second casting trial shows that the feeder systems of the invention satisfy the physical demands and dimensional restrictions of high pressure moulding lines, and the volume driven feeding requirements of castings produced in vertically parted moulding machines.

The invention claimed is:

1. A feeder element for use in metal casting, said feeder element comprising:

a first end for mounting on a mould pattern or swing plate;

an opposite second end comprising a mounting plate for mounting on a feeder sleeve; and a bore between the first and second ends defined by a sidewall;

said feeder element being compressible in use whereby to reduce the distance between the first and second ends;

wherein said bore has an axis that is offset from the centre of said mounting plate and wherein an integrally formed rim extends from a periphery of said mounting plate.

2. The feeder element according to claim 1, wherein the mounting plate is elongate and/or asymmetrical and, when oriented in use, has a vertical dimension which is longer than a horizontal dimension, thereby defining a pair of long peripheral edges.

3. The feeder element according to claim 2, wherein the rim extends at least partially along the long peripheral edges of the mounting plate.

4. The feeder element according to claim 1, wherein the bore is located substantially centrally with respect to the nominal width of the mounting plate.

5. The feeder element according to claim 1, wherein the rim is in the form of a pair of tabs each extending along a respective one of the long peripheral edges.

6. The feeder element according to claim 1, wherein the rim extends continuously around the periphery of the mounting plate so as to form a skirt.

7. The feeder element according to claim 1, wherein the depth of the rim is at least 5 mm.

8. The feeder element according to claim 1, wherein the sidewall defining the bore comprises at least one step, and wherein the second sidewall region is provided at a different angle, with respect to the bore axis, to the first sidewall region.

9. The feeder element according to claim 1, wherein the initial crush strength of the feeder element is no more than 7000 N.

10. The feeder element according claim 1, wherein the initial crush strength of the feeder element is at least 250 N.

11. The feeder element according to claim 1, wherein the sidewall of the feeder element comprises a first series of sidewall regions, said series having at least one member, in the form of rings of increasing diameter interconnected and integrally formed with a second series of sidewall regions, said second series having at least one member.

12. The feeder element according to claim 11, wherein the sidewall regions are of substantially uniform thickness so that the diameter of the bore of the feeder element increases from the first end to the second end of the feeder element.

13. The feeder element according to claim 11, wherein the length of the first series of sidewall regions and/or the second series of sidewall regions incrementally increases towards the first end of the feeder element.

14. A feeder system for metal casting comprising a feeder element in accordance with claim 1 and a feeder sleeve secured thereto.

15. The feeder element according to claim 8, wherein each step is formed by a first sidewall region and a second sidewall region contiguous with the first sidewall region.

16. The feeder element according to claim 1, wherein the mounting plate is substantially planar and the rim is inclined away from the first end of the feeder element at an angle of up to 90° with respect to the plane of the mounting plate.

17. The feeder element according to claim 1, wherein the mounting plate is substantially planar and the rim is inclined away from the first end of the feeder element at an angle of substantially 90° with respect to the plane of the mounting plate.

* * * * *